US005255870A

United States Patent [19]

Romagnoli

[11] Patent Number: 5,255,870

[45] Date of Patent: Oct. 26, 1993

[54] INTERLOCKING DYEING SUPPORT, FOR PARTICULAR USE ON OPEN-END SPINNING MACHINES AND OTHER MACHINERY

[76] Inventor: Mauro Romagnoli, Via dei Casini No. 53, Prato, Italy

[21] Appl. No.: 950,956

[22] Filed: Sep. 25, 1992

[30] Foreign Application Priority Data

Oct. 1, 1991 [IT] Italy ..... FI/91/U-122

[51] Int. Cl.[5] ..... B65H 75/10; B65H 75/20; B65H 75/26

[52] U.S. Cl. ..... 242/118.1; 242/118.3

[58] Field of Search ..... 242/118.1, 118.11, 118.3, 242/118.31, 118.32; 68/189, 198

[56] References Cited

U.S. PATENT DOCUMENTS

| | | | |
|---|---|---|---|
| 3,095,161 | 6/1963 | Atwood et al. | 242/118.3 X |
| 3,138,345 | 6/1964 | Luber | 242/118.3 X |
| 3,141,631 | 7/1964 | Krebs | 242/118.3 |
| 3,746,275 | 7/1973 | Whisnant | 242/118.32 |
| 3,752,414 | 8/1973 | Urquhart | 242/118.32 |
| 4,272,037 | 6/1981 | Becker et al. | 242/118.1 |
| 4,519,557 | 5/1985 | Newman | 242/118.3 X |
| 4,545,222 | 10/1985 | Rost | 242/118.1 X |
| 4,596,366 | 6/1986 | Dick et al. | 242/118.3 |
| 4,632,332 | 12/1986 | Newman | 242/118.3 |
| 4,667,895 | 5/1987 | Becker et al. | 242/118.1 |
| 4,811,917 | 3/1989 | Nielsen et al. | 242/118.1 |

FOREIGN PATENT DOCUMENTS

| | | |
|---|---|---|
| 1501640 | 11/1966 | France . |
| 2024191 | 11/1969 | France . |
| 2626296 | 7/1989 | France . |
| 2000746 | 6/1978 | United Kingdom . |

*Primary Examiner*—Stanley N. Gilreath
*Attorney, Agent, or Firm*—McGlew and Tuttle

[57] ABSTRACT

A dyeing support made of a synthetic material, for the building up of yarn in coils. The support having a center in three sections 1, 3, 5. The first of which 1, of greater axial length, tapering slightly from the larger base 1A. The second or intermediate section 3, of limited axial length, being frustoconical and having superficial serrations 3A. The third of which 5 being basically cylindrical, of intermediate axial length relative to that of the other two sections and having an end connected to the smaller base end of the intermediate section 4-3. The support has distributed perforations 9, 12 and sholders 16A inside the first section for the support of the terminal rim 5B of the third section 5 of another axially coupled support.

14 Claims, 1 Drawing Sheet

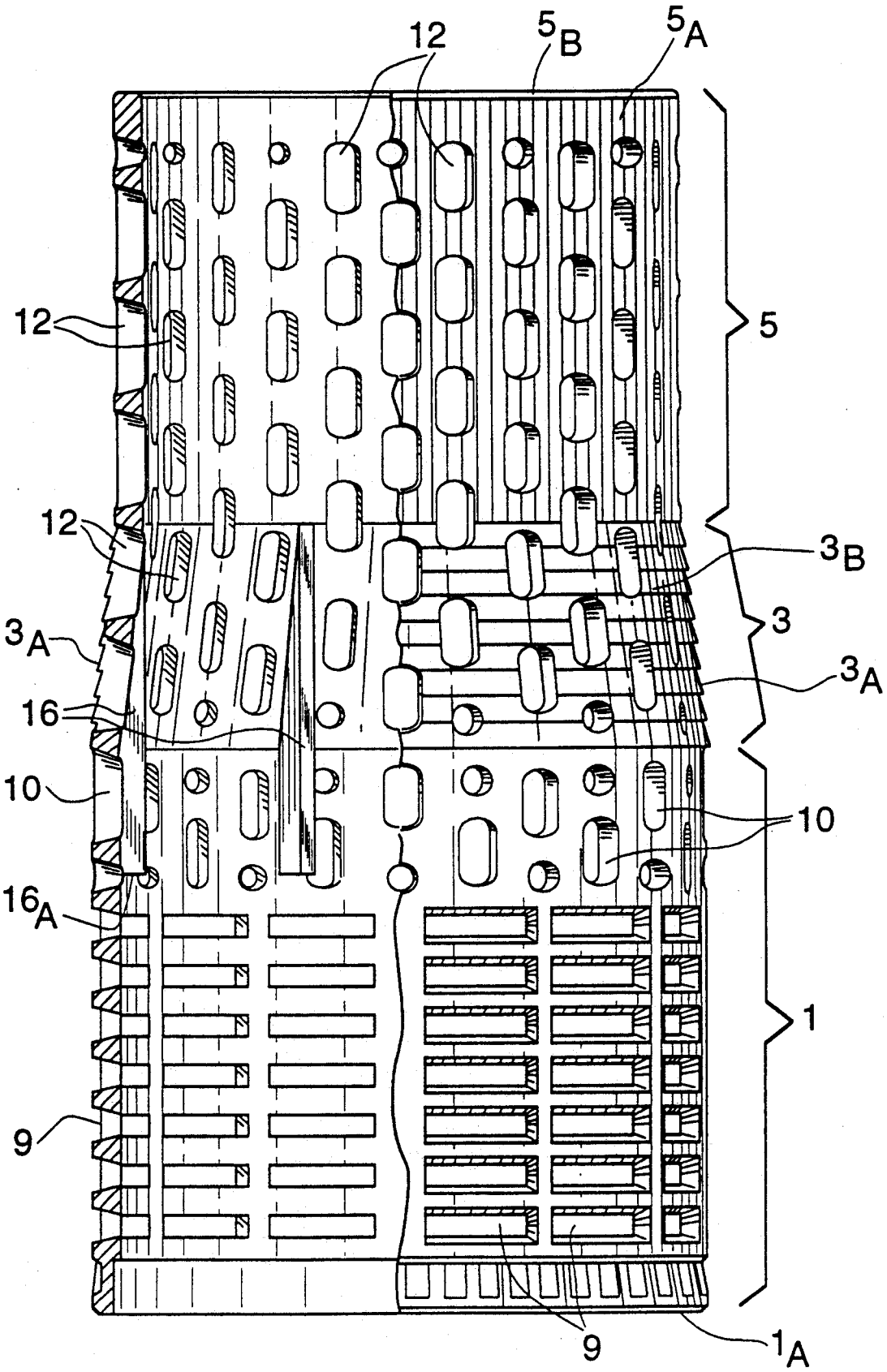
12
5B
5A
12
5
12
3B
3A
3
3A
16
10
10
16A
1
9
9
1A

INTERLOCKING DYEING SUPPORT, FOR PARTICULAR USE ON OPEN-END SPINNING MACHINES AND OTHER MACHINERY

FIELD OF THE INVENTION

The subject of the invention is a dyeing support of the interlocking type made of a synthetic material, for the building up of yarn in coils. This support is improved to meet requirements of winding operations on open-end type spinning machines, which comprise rollers spinning around the circumferential periphery of the support, and other machinery.

SUMMARY AND OBJECTS OF THE INVENTION

Basically, the support comprises a center in three sections, the first of which, of greater axial length, taper slightly from the larger base. The second or intermediate section, is of limited axial length, is frustoconical and has superficial serrations. The third section is basically cylindrical, of intermediate axial length relative to that of the other two sections, and has an end connected to the smaller base of the intermediate section.

The support has distributed perforations and has shoulders inside the first section for the support of the terminal rim of the third section of another axially coupled and interlocking support.

The first section of the center may have an axial length of approximately half the total length of the support and the third section an axial length of approximately one third of the total length.

Advantageously, the third section of the center has—on the outer surface—longitudinal or axially extending microgrooves to facilitate the sliding of the coils.

The perforations may be arranged in longitudinal columns and the perforations of one column are offset relative to those of the adjacent columns.

In practice the internal shoulders are formed by fins.

The first section may have an external taper of between approximately 1° and 3° and particularly of around 2°.

BRIEF DESCRIPTION OF THE DRAWINGS

The drawing shows a partial sectional view of a possible embodiment of the invention and in particular the drawing shows the support in an external elevation in partial section through an axial plane.

DETAILED DESCRIPTION OF THE PREFERRED EMBODIMENT

In the form illustrated in the attached drawing, the dyeing support according to the invention has three sections indicated as a whole by 1, 3 and 5 which are adjacent to each other. The section 1 of largest dimensions tapers slightly from the larger base 1A with a taper which is approximately from 1° to 3° and generally of approximately 2°. The axial length of the section 1 is approximately half the total height of the support. The section 3 is the section of least axial length having an axial length of around one sixth of the total height of the support. The third section indicated by 5 has an axial length of around one third of the total height of the support and is a basically cylindrical section. Characteristically the outside of the section 5 has microgrooves 5A extending an axial direction and whose purpose is to facilitate the sliding of the yarn coils wound around the support center shaped as described above. The surface of the intermediate section 3 is serrated or has a sawtooth like surface 3A, as is clearly visible in particular in the profile of the outside or right and left sides of section 3 as shown in the FIGURE. This serration indicated in the front elevation of the FIGURE by 3B extends over virtually the whole of the surface which is interrupted by perforations defined more precisely below. The section 1 is basically smooth. The area of section 1 nearest to the larger base 1A of the support has a series of slots 9 lying transversely. In the area closest to the second section 3, the section 1 has a series of elongated longitudinal perforations 10 which are offset with respect to each other in the circumferential direction. The section 3, too, has a series of elongated longitudinal perforations 12, which are arranged on longitudinal columns, the perforations of one column being offset relative to those of the adjacent columns. The same complex of perforations is also present in the section 5 where they are also indicated by 12 and are offset in the manner already indicated above. The purpose of the holes is to allow the dyeing liquor to pass from the inside to the outside of the support and vice versa. The offset of the perforations 10, 12 is designed to fulfil the double purpose of offering on the outside of the support a sufficiently continuous outer surface for the circumferential engagement of a rotating roller, and in the second place also to reduce as far as possible the concentration of the discontinuities presented by the extremities of the elongated perforations 12 so as to avoid impediments to the axial sliding of the yarn coils along the outer surface of the support center. The provision of the rotating roller is envisioned to allow the present support to be used in certain highly automated machines and more generally to make the support usable for many applications. The microgrooves 5A of the section 5 have the purpose of enabling easy sliding of the coils by reducing the friction between the coils and the surface of the center, and also the purpose of making the outer surface of the support badically regular for the spinning of rollers which travel over it circumferentially relative to the center.

The slight taper or narrowing of the section 1 allows adaptation particularly to machines of the open-end type and others. This taper has the purpose of limiting the longitudinal discontinuity of the support between the section 1 and the section 5, that is of reducing the difference of diameters in the intermediate area represented by the section 3.

Internally, the support has a plurality of axial shoulders 16A, defined by longitudinal fins 16. The shoulders 16A lie in the innermost area of the section 1 and the fins run from said shoulders 16A and along the section 3. The distance between the shoulders 16A and the rim 1A of the larger base of the support is less than or at the most equal to the axial length of the section 5 of the support. The shoulders 16A provide support for the terminal rim 5B of the section 5 of an axially adjacent support whose section 5 fits inside the section 1.

Constructed as described, the support can be used for many types of machine, including largely automated machines, and is in fact a largely standardized support that is not intended for highly specialized machines but for practically universal use. These and other objects and advantages will be particularly clear to workers in the industry.

I claim:

1. A dyeing support made of a synthetic material, for the building up of yarn in coils, for open-end type spinning machines, said support comprising: a center in three sections, a first section having a first axial length, tapering slightly from a larger base, a second section of a second axial length, said second section being frustoconical and having superficial serrations, a third section having a substantially cylindrical shape, and an axial length intermediate relative to that of said first and second sections and starting at a smaller base end of said second section; said support having distributed perforations and having shoulders inside said first section for support of a terminal rim of the third section of an axially coupled and interlocking support.

2. The support as claimed in claim 1, wherein said first axial length of the first section of the support is approximately half a total length of the support and said axial length of the third section is approximately one third of the total length.

3. The support as claimed in claim 1, wherein said third section has, on an outer surface, longitudinal microgrooves.

4. The support as claimed in claim 1, wherein the perforations are arranged in longitudinal columns and the perforations of one column are offset relative to those of the adjacent columns.

5. The support as claimed in claim 1, wherein the shoulders are formed by fins.

6. The support as claimed in claim 1, wherein the first section has a taper of between approximately 1° and 3° and particularly of around 2°.

7. A dyeing support comprising:

a first section having a substantially cylindrical shape and a first axial length, said first section having an inward taper from a first end to a second end, said first section defining a plurality of perforations;

a second section having a substantially frustoconical shape with a large end connected to said second end of said first section, said second section having a second axial length and also defining a plurality of perforations, an external surface of said second section having superficial serrations;

a third section having a substantially cylindrical shape and having an end connected to a small end of said second section, said third section having an axial length between said first and second axial lengths, said third section defining perforations and having another end with a terminal rim;

shoulder means positioned inside said first section and for supporting a terminal rim of another axially coupled and interlocked support.

8. A support in accordance with claim 7, wherein:

said first section also defines a plurality of slots extending transversely to a longitudinal axis of said first section.

9. A support in accordance with claim 7, wherein:

said plurality of perforations of each of said first, second and third sections are arranged in a plurality of longitudinal columns and positions of said perforations of one column are offset from positions of said perforations of adjacent columns.

10. A support in accordance with claim 7, wherein:

said shoulder means includes a plurality of fins, each of said plurality of fins extending longitudinally and having a shoulder positioned inside said first section for abutting against said terminal rim of said another support.

11. A support in accordance with claim 10, wherein:

each of said fins extends from said shoulder into said second section and tappers downward to end at said small end of said second section.

12. The support as claimed in claim 7, wherein said first axial length of the first section of the support is approximately half a total length of the support and said axial length of the third section is approximately one third of the total length.

13. The support as claimed in claim 7, wherein said third section has, on an outer surface, longitudinal microgrooves.

14. The support as claimed in claim 7, wherein the first section has a taper of between approximately 1° and 3° and particularly of around 2°.

* * * * *